US008851941B2

(12) United States Patent
Onuma

(10) Patent No.: US 8,851,941 B2
(45) Date of Patent: Oct. 7, 2014

(54) CRIMPING TERMINAL AND MANUFACTURING OF SAME

(75) Inventor: Masanori Onuma, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/640,810

(22) PCT Filed: Apr. 12, 2011

(86) PCT No.: PCT/JP2011/059094

§ 371 (c)(1),
(2), (4) Date: Oct. 12, 2012

(87) PCT Pub. No.: WO2011/129333

PCT Pub. Date: Oct. 20, 2011

(65) Prior Publication Data

US 2013/0035007 A1 Feb. 7, 2013

(30) Foreign Application Priority Data

Apr. 13, 2010 (JP) ..... 2010-092133

(51) Int. Cl.
*H01R 4/10* (2006.01)
*H01R 4/18* (2006.01)
*H01R 43/16* (2006.01)

(52) U.S. Cl.
CPC ..... *H01R 4/185* (2013.01); *H01R 43/16* (2013.01)
USPC ..... 439/877

(58) Field of Classification Search
USPC ..... 439/877, 850, 852
See application file for complete search history.

(56) References Cited

U.S. PATENT DOCUMENTS

| | | | | |
|---|---|---|---|---|
| 2,854,648 | A | 9/1958 | Berg | |
| 3,892,459 | A | 7/1975 | Dittmann et al. | |
| 5,316,506 | A | 5/1994 | Ito | |
| 5,356,318 | A | 10/1994 | Fry et al. | |
| 5,370,560 | A | 12/1994 | Ito | |
| 5,733,154 | A * | 3/1998 | Libregts | 439/850 |
| 6,626,711 | B2 * | 9/2003 | Kitagawa et al. | 439/877 |

(Continued)

FOREIGN PATENT DOCUMENTS

| | | | |
|---|---|---|---|
| JP | 53-143987 | A | 12/1978 |
| JP | 04118874 | A | 4/1992 |

(Continued)

OTHER PUBLICATIONS

International Search Report dated May 17, 2011 issued in International Application No. PCT/JP2011/059094 (PCT/SA/210).

(Continued)

*Primary Examiner* — Alexander Gilman
(74) *Attorney, Agent, or Firm* — Sughrue Mion, PLLC

(57) ABSTRACT

Disclosed is a crimping terminal that suppresses as far as possible an increase in contact resistance with an electrical wire even in a severe thermal impact environment. A crimping terminal is formed into a substantial U-shape section with a bowed bottom plate. Also, a bead is formed whose in inner surface is made convex by punching a concave shape from an outer surface of a wall plate, on the wall plate at any position in a range from at least a bottom plate to a conductor swage piece. A work hardening portion hardened by crushing at a center portion in a width direction of the bottom plate is also formed.

2 Claims, 6 Drawing Sheets

(56) References Cited

U.S. PATENT DOCUMENTS

| | | | | |
|---|---|---|---|---|
| 8,328,589 | B2 * | 12/2012 | Hasebe et al. | 439/877 |
| 8,622,774 | B2 * | 1/2014 | Seifert et al. | 439/882 |
| 2009/0130923 | A1 | 5/2009 | Kuwayama | |
| 2011/0073365 | A1 | 3/2011 | Kuwayama et al. | |
| 2011/0177728 | A1 | 7/2011 | Uchiyama et al. | |

FOREIGN PATENT DOCUMENTS

| | | | |
|---|---|---|---|
| JP | 5152011 | A | 6/1993 |
| JP | 07135031 | A | 5/1995 |
| JP | 2009-252449 | A | 10/2009 |
| JP | 2010-44913 | A | 2/2010 |
| JP | 2010-55875 | A | 3/2010 |
| JP | 2010067478 | A | 3/2010 |
| WO | 2009/064009 | A2 | 5/2009 |

OTHER PUBLICATIONS

Written Opinion dated May 17, 2011 issued in International Application No. PCT/JP2011/059094 (PCT/SA/237).

Extended European Search Report, dated Jun. 12, 2014, issued by the European Patent Office in counterpart European Application No. 11768854.9.

Communication dated Jul. 1, 2014 from the State Intellectual Property Office of P.R. China in a counterpart application No. 201180019167.7.

* cited by examiner

FIG.1A
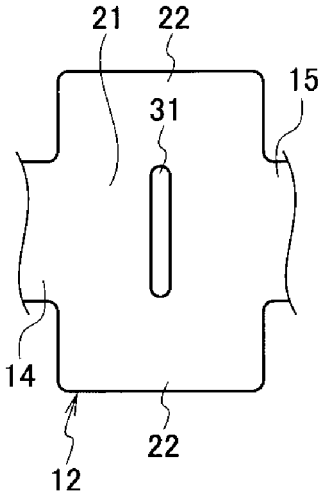
FIG.1B
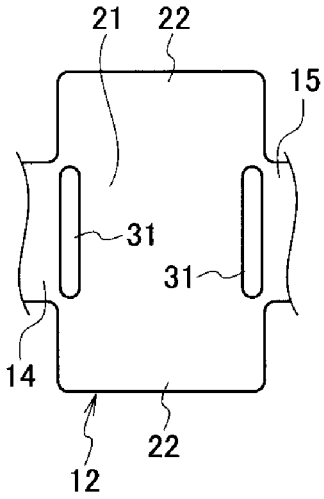
FIG.1C
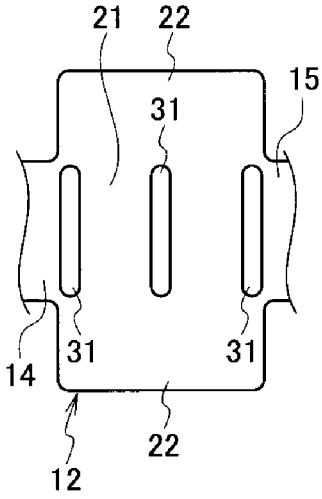
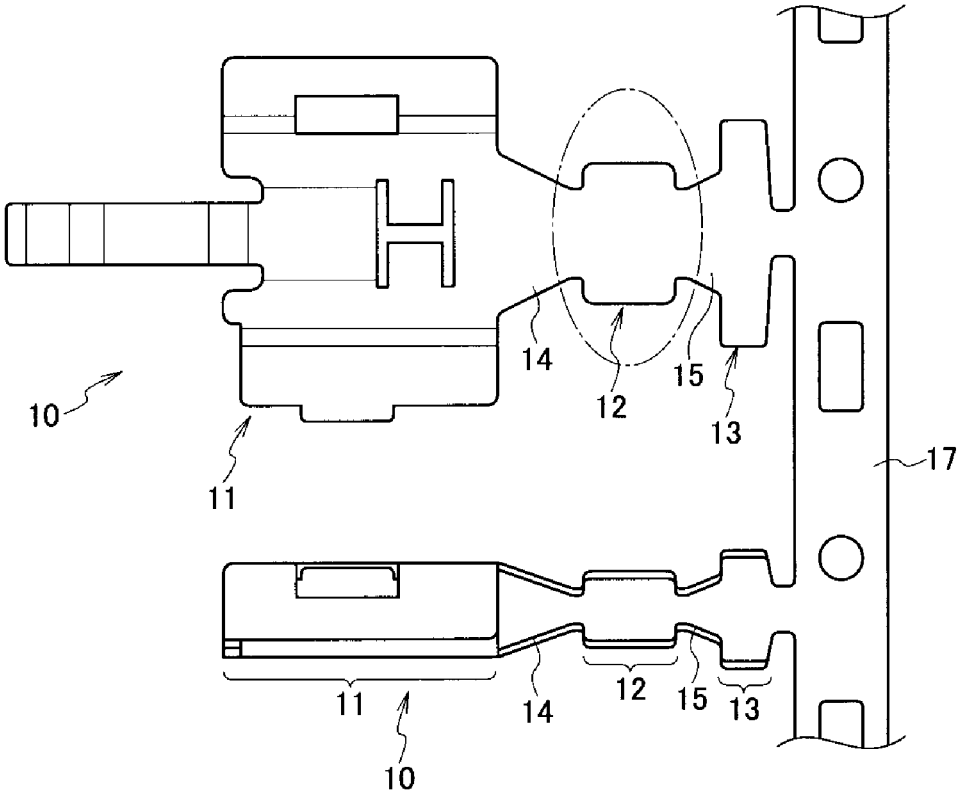
FIG.1D

CRIMPING TERMINAL AND MANUFACTURING OF SAME

This is a national stage entry of International Application No. PCT/JP2011/059094 filed Apr. 12, 2011, which claims the benefit of Application No. JP 2010-092133 filed Apr. 13, 2010, in the Japanese Patent Office (JPO), the disclosures of which are incorporated herein in their entirety by reference.

TECHNICAL FIELD

The invention relates to an open barrel type crimping terminal having a conductor crimping portion having a substantially U-shaped section or substantially right-angled U-shaped section to be used in an electric system of an automobile, for example, and a method of manufacturing the crimping terminal.

BACKGROUND ART

FIGS. 8A and 8B are sectional views showing a state where a conductor crimping portion 512 of a general crimping terminal is swaged to a conductor W of an electric wire (for example, refer to Patent Document 1).

In general, the conductor crimping portion 512 of the crimping terminal is formed into a substantially U-shaped section with a slightly bent bottom plate 521 by the bottom plate 521 and a pair of conductor swage pieces 522, 522 that extends upward from both left and right edges of the bottom plate 521, is rolled inward to wrap the conductor W of the electric wire placed on an inner surface of the bottom plate 521 and is swaged so that a leading end thereof is bitten to the conductor W, respectively.

Since the crimping terminal is mounted on a vehicle, the crimping terminal should sufficiently bear thermal impact. For example, in a sampling evaluation test, the conductor crimping portion 512 is continuously applied with repeating stress of high (about 120 degrees) to low (normal temperature) temperatures, as the thermal impact.

The solid line of FIG. 8A indicates a deformed shape at high temperature and the broken line indicates a deformed shape at low temperature. Also, the solid line of FIG. 8B indicates a deformed shape at low temperature and the broken line indicates a deformed shape at high temperature.

Like this, as the environmental temperature continuously repeats between the high and low temperatures, the conductor crimping portion 512 repeats expansion as shown in FIG. 8B and contraction as shown in FIG. 8B, as if it respires. However, in some terminals, it was found that a contact resistance between the conductor and the terminal is increased as the thermal impact is repeated.

Studying on the cause, it was found that the terminal (conductor crimping terminal 512) covering the conductor W from the outside may slightly move relative to the conductor W during the repeating thermal expansion and thermal contraction and the crimping performance may be thus highly lowered. In particular, analyzing the movement of the conductor crimping portion 512, it was understood that bending deformation of the bottom plate 521 about a central portion G in a width direction of the bottom plate 521 of the conductor crimping portion 512 or movement of parts extending from the bottom plate 521 to the conductor swage pieces 522 is important. Based on this, it was found that when the part extending from the bottom plate 521 to the conductor swage pieces 522 is highly deformed, a high influence on the contact resistance between the conductor W and the terminal is apt to occur.

PRIOR ART DOCUMENT

Patent Documents

Patent Document 1: JP-A-7-135031

SUMMARY OF INVENTION

Problems to Be Solved by Invention

As described above, according to the conventional crimping terminal, the rigidity of the conductor crimping portion 512 is insufficient. Thereby, when the conductor crimping portion 512 is applied with the repeating thermal impact of high and low temperatures, the relative movement is apt to occur between the crimping terminal and the conductor of the electric wire. Hence, the contact resistance between the terminal and the connection portion of the electric wire is increased, so that the electrical connection performance may be lowered. Particularly, in recent years, as it is required to make the terminal smaller or thinner, the above problem needs to be solved.

Considering the above situations, an object of the invention is to provide a crimping terminal capable of effectively improving rigidity of a central portion in a width direction of a bottom plate of a conductor crimping portion or a part extending from the bottom plate to a conductor swage piece and suppressing as far as possible as an increase in contact resistance with an electric wire even in a severe thermal impact environment, and a method of manufacturing the same.

Means for Solving Problems

In order to solve the above problems, a crimping terminal according to a first invention is characterized by having a conductor crimping portion that is crimped and connected to a conductor of an electric wire, the crimping terminal formed into a substantially U-shaped section with a curved bottom plate or a substantially right-angled U-shaped section with a planar bottom plate by the bottom plate having an inner surface on which the conductor of the electric wire is placed and a pair of left and right conductor swage pieces each of which extends from both left-right sides of the bottom plate, is rolled inward to wrap the conductor placed on the inner surface of the bottom plate and is swaged so that a leading end thereof is bitten to the conductor, wherein a bead is formed at least on a wall plate at any position in a range from the bottom plate to the conductor swage pieces, the bead in which an inner surface of the wall plate is formed into convex shape by punching an outer surface of the wall plate into concave shape, and wherein a work hardening portion hardened by crushing is formed at a central portion of the bottom plate in a width direction thereof.

A method of manufacturing a crimping terminal according to a second invention is characterized by having a conductor crimping portion that is crimped and connected to a conductor of an electric wire, the crimping terminal formed into a substantially U-shaped section with a curved bottom plate or a substantially right-angled U-shaped section with a planar bottom plate by the bottom plate having an inner surface on which the conductor of the electric wire is placed and a pair of left and right conductor swage pieces each of which extends from both left-right sides of the bottom plate, is rolled inward to wrap the conductor placed on the inner surface of the bottom plate and is swaged so that a leading end thereof is bitten to the conductor, the method comprising: forming a flat developed terminal shape on one metal plate by press punching and at the same time forming a bead at least on a wall plate at any position in a range from the bottom plate to the conductor swage pieces, the bead in which an inner surface of the wall plate is formed into convex shape by punching an outer surface side of the wall plate into concave shape at the time of bending the wall plate to form the conductor swage pieces from the bottom plate, and after the forming, when bending the conductor swage pieces into the substantially U-shaped section or substantially right-angled U-shaped section from the bottom plate by pressing the wall plate, while crushing a central portion of the bottom plate in a width direction thereof by a crushing mold, bending the conductor swage pieces from the bottom plate with the bead being left as it is and the crushed part of the bottom plate serving as a work hardening portion.

Advantageous Effects of Invention

With the crimping terminal according to the first invention, since the crimping terminal is provided with the work hardening portion hardened by the crushing at the central portion of the bottom plate of the conductor crimping portion in the width direction thereof, it is possible to reduce the movement of the bottom plate, upon the thermal impact from the central portion in the width direction of the bottom plate. Also, since the beads having the work hardening effect are formed at the portions from the bottom plate to the conductor swage pieces, it is possible to lower the Young's modulus of the corresponding portion, thereby suppressing the deformation upon the thermal impact. Accordingly, it is possible to suppress the lowering of the crimping performance on the electric wire, which is caused due to the repeated deformation resulting from the thermal impact, so that it is possible to stably suppress the increase in contact resistance between the crimping terminal and the electric wire for a long time.

With the method of manufacturing the crimping terminal according to the second invention, since the work hardening portion is formed at the central portion in the width direction of the bottom plate of the conductor crimping portion by the crushing, separately from the press-worked bead, at the time of developing the flat terminal shape, it is possible to simply obtain the crimping terminal according to the first invention and the advantageous effect thereof.

BRIEF DESCRIPTION OF DRAWINGS

FIGS. 1A to 1D are plan views showing a shape of a crimping terminal of an illustrative embodiment of the invention, which is developed by press working, and a terminal shape as an article, where FIGS. 1A to 1C are plan views showing a developed state (a part surrounded by the dashed-dotted line) of a conductor crimping portion in the crimping terminal shown in FIG. 1D in which FIG. 1A is a case where one bead is provided at a central portion in a longitudinal direction of the terminal, FIG. 1B shows a case where two beads are provided at both ends in the longitudinal direction of the terminal, FIG. 1C shows a case where three beads are provided at the central portion and both ends in the longitudinal direction of the terminal and FIG. 1D is a plan view showing a shape of the crimping terminal developed by press working and a terminal shape as an article.

FIGS. 8A and 8B are sectional views showing a state where a conductor crimping portion of a general crimping terminal according to the prior art is swaged to a conductor of an electric wire, in which FIG. 8A shows a state of high temperature with the solid line when a thermal impact test is performed and FIG. 8B shows a state of low temperature with the solid line.

EMBODIMENTS OF INVENTION

Hereinafter, illustrative embodiments of the invention will be described with reference to the drawings.

Figure 2:
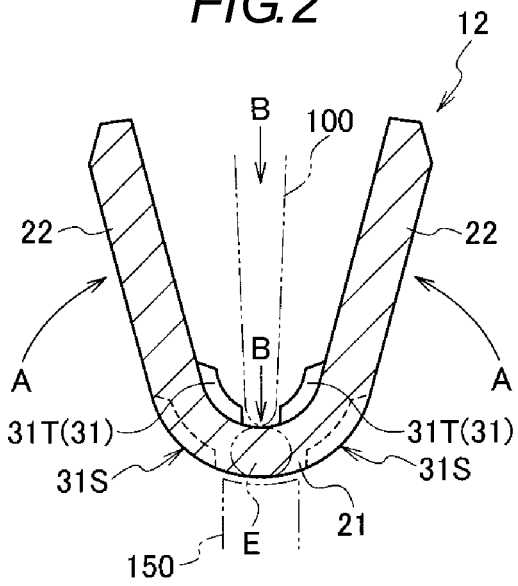
FIG. 2 is a sectional view showing an article state before the conductor crimping portion of the crimping terminal is swaged to a conductor.
Figure 3:
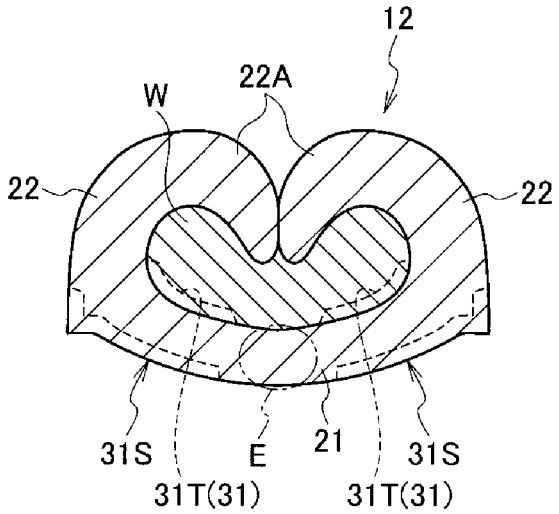
FIG. 3 is a sectional view showing an article state after the conductor crimping portion of the crimping terminal is swaged to the conductor.
Figure 4:
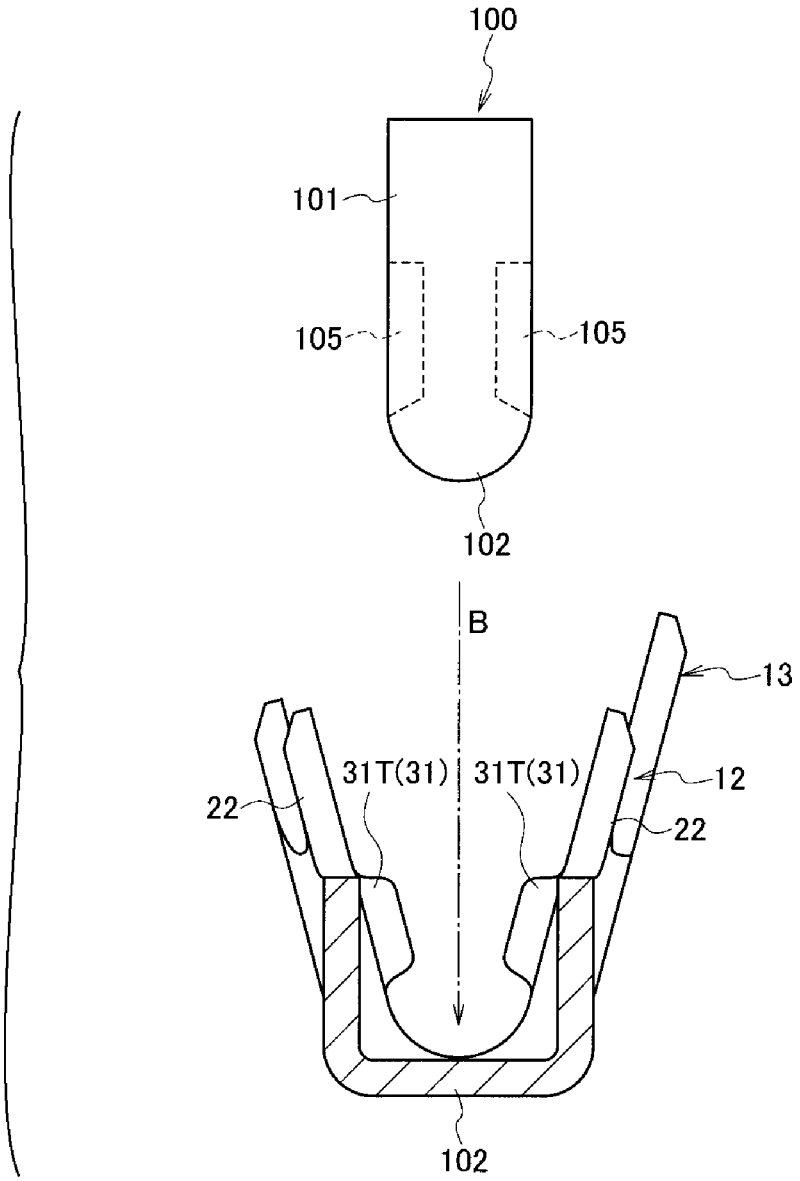
FIG. 4 is a front view showing a relation between the conductor crimping portion of the crimping terminal and a crushing mold when bending the conductor crimping portion of the crimping terminal.
Figure 5:
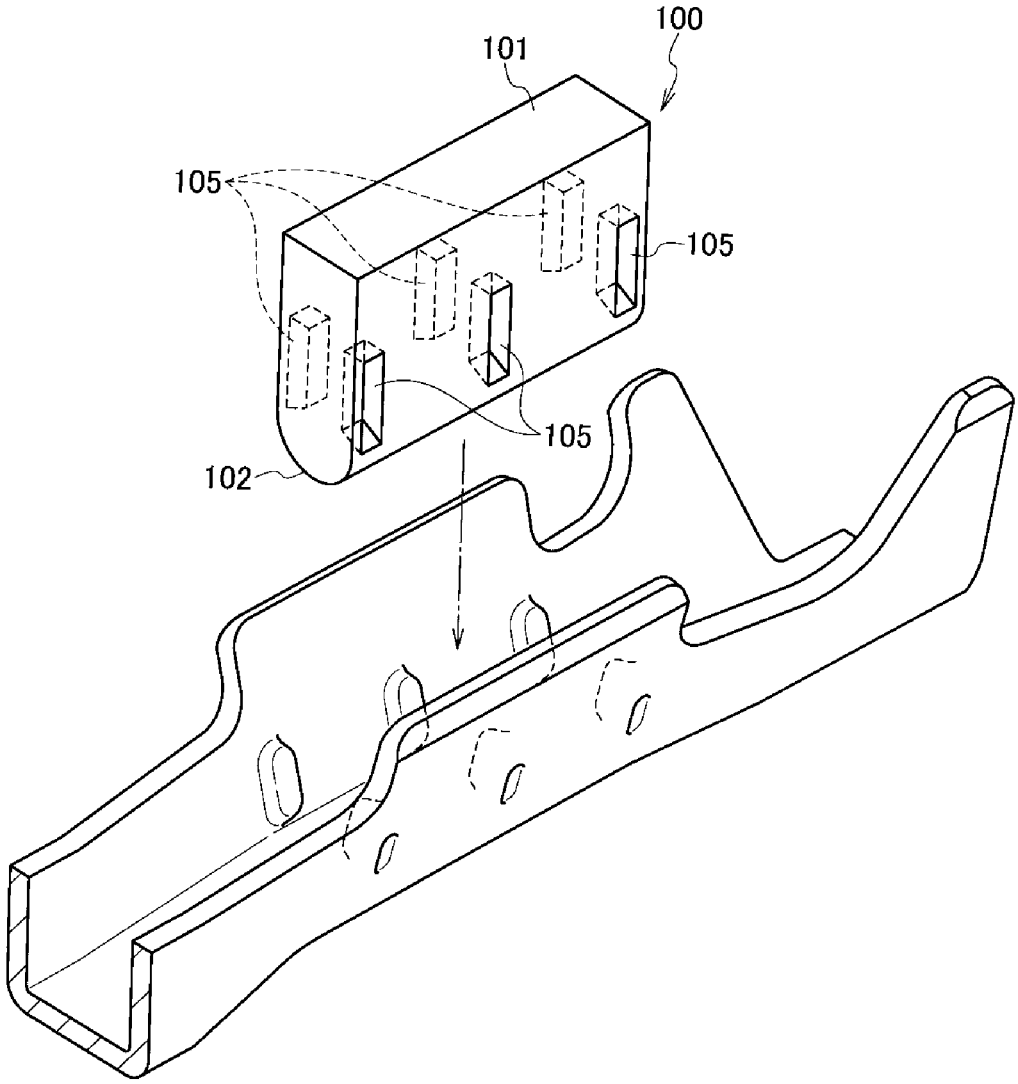
FIG. 5 is a perspective view showing a relation between the conductor crimping portion of the crimping terminal and a crushing mold when bending the conductor crimping portion of the crimping terminal.

FIGS. 1A to 1D are plan views showing a shape of a crimping terminal of an illustrative embodiment of the invention, which is developed by press working, and a terminal shape as an article, where FIGS. 1A to 1C are plan views showing a developed state of a conductor crimping portion in the crimping terminal in which FIG. 1A is a case where one bead is provided at a central portion in a longitudinal direction of the terminal, FIG. 1B shows a case where two beads are provided at both ends in the longitudinal direction of the terminal, FIG. 1C shows a case where three beads are provided at the central portion and both ends in the longitudinal direction of the terminal and FIG. 1D is a plan view showing a shape of the crimping terminal developed by press working and a terminal shape as an article. FIG. 2 is a sectional view showing an article state before the conductor crimping portion of the crimping terminal is swaged to a conductor, FIG. 3 is a sectional view showing an article state after the conductor crimping portion of the crimping terminal is swaged to the conductor, FIG. 4 is a front view showing a relation between the conductor crimping portion of the crimping terminal and a crushing mold when bending the conductor crimping portion of the crimping terminal and FIG. 5 is a perspective view showing a relation between the conductor crimping portion of the crimping terminal and a crushing mold when bending the conductor crimping portion of the crimping terminal.

As shown in FIGS. 1A to 1D, a crimping terminal 10 is press-processed and manufactured into a chain shape on one metal plate with one edge thereof being connected to a carrier 17. A reference numeral 10 in FIG. 1D indicates a crimping terminal or a part becoming a crimping terminal. The part 10 becoming a crimping terminal is formed into a flat developed terminal shape by press-punching one metal plate.

The crimping terminal 10 has an electric connection portion 11 to the other terminal and the like at a front end side in an extending direction of a connection electric wire (hereinafter, the direction is referred to as a 'front-rear direction' and a direction orthogonal to the direction is referred to as a 'left-right direction', a conductor crimping portion 12 at a rear end side, which is swaged to an exposed conductor W (for example, refer to FIG. 3) of a leading end of the electric wire, and a covering swage portion 13 that is swaged to a covered part of the electric wire. The electric connection portion 11, the conductor crimping portion 12 and the covering swage portion 13 have a common bottom plate and are continuously formed. A reference numeral 14 in FIGS. 1A to 1C indicates a connection portion between the electric connection portion 11 and the conductor crimping portion 12 and a reference numeral 15 indicates a connection portion between the conductor crimping portion 12 and the covering swage portion 13.

At an article state before being swaged to the electric wire, the conductor crimping portion 12 is formed into a substantially U-shaped section with a curved bottom plate 21 by the bottom plate 21 having an inner surface on which the conductor W of the electric wire is placed and a pair of left and right conductor swage pieces 22, 22 that extends in the left-right direction of the bottom plate 21, is rolled inward to wrap the conductor W placed on the inner surface of the bottom plate 21 and is swaged so that a leading end 22A thereof is bitten to the conductor W, respectively.

Also, as shown in FIGS. 1A to 1C, at a stage where the crimping terminal is formed into a flat developed terminal shape by press working, a bead 31 having an inner surface that is made convex 31T by punching a concave shape from an outer surface of a wall plate is formed on the wall plate at any position in a range from at least the bottom plate 21 to the conductor swage piece 22 (punched concave portion is indicated with a reference numeral 31S in FIGS. 2 and 3).

At a stage where the press working to the planar shape is completed, the electric connection portion 11, the conductor crimping portion 12 and the covering swage portion 13 are bent in a next press process. At this time, when bending the conductor swage pieces 22 from the bottom plate 21 of the conductor crimping portion 12 into the substantially U-shaped section (bending processing shown with the arrow A in FIG. 2), the bottom plate 21 is strongly crushed at a center in a width direction thereof by a leading pressing portion 102 of a crushing mold 100 that is prepared in advance, as shown with the arrow B in FIGS. 4 and 5, and the conductor swage pieces 22 are bent from the bottom plate 21 with the bead 31 being left as it is and the crushed part of the bottom plate 21 serving as a work hardening portion E. In this case, since the convex portions 31T of the beads 31 should be left on the inner surface of the conductor crimping portion 12, an outer periphery of a main body 101 of the crushing mold 100 is provided at necessary positions with recess portions 105 housing the convex portions 31T of the beads 31, as required. In this embodiment, since the six beads 31 are scattered, the crushing mold 100 is used which has the recess portions 105 at positions corresponding to the beads. Also, a bearing stand 150 for bearing a downward force of the crushing mold 100 is required.

In order to crimp the conductor crimping portion 12 of the crimping terminal to the conductor W of the leading end of the electric wire, the crimping terminal 10 is placed on a placing plane of a lower mold (not shown) and the exposed conductor W of the leading end of the electric wire is inserted between the left and right conductor swage pieces 22 and is then placed on the bottom plate 21. Then, an upper mold (not shown) is lowered, so that the leading ends 22A of the conductor swage pieces 22 are slowly rolled inward by an inclined guide surface of the upper mold. Also, the leading ends 22A of the conductor swage pieces 22 are rolled so that they are folded back toward the conductor W by the inclined guide surface. Thereby, as shown in FIG. 3, the leading ends 22A are rubbed each other and bitten into the conductor W, so that the conductor swage pieces 22 are swaged to wrap the conductor W. The conductor swage pieces 22 are swaged as described above, so that it is possible to crimp the conductor crimping portion 12 to the conductor W of the electric wire and to enable the metal configuring the crimping terminal 10 and the conductor W of the electric wire to cohere each other (to connect each other in a molecular or atomic level). Thus, it is possible to connect the crimping terminal 10 and the electric wire electrically and mechanically strongly.

When the crimping is made as described above, since the crimping terminal 10 is provided with the work hardening portion E hardened by the crushing at the central portion of the bottom plate 21 of the conductor crimping portion 12 in the width direction thereof, it is possible to reduce the movement of the bottom plate 21, upon the thermal impact from the central portion in the width direction of the bottom plate 21. Also, since the beads 31 having the work hardening effect are formed at the portions from the bottom plate 21 to the conductor swage pieces 22, it is possible to lower the Young's modulus of the corresponding portion, thereby suppressing the deformation upon the thermal impact. Accordingly, it is possible to suppress the lowering of the crimping performance on the electric wire, which is caused due to the repeated deformation resulting from the thermal impact, so that it is possible to stably suppress the increase in contact resistance between the crimping terminal 10 and the electric wire for a long time. Also, due to a protruding value of the convex portion 31T of the bead 31 (a step with respect to the bottom plate 21 or inner surface of the conductor swage piece 22), it is possible to expect that the movement of the conductor W will be restrained by friction and will be suppressed by the protrusion. Therefore, the effect of restraining the relative movement between the electric wire and the terminal in an axial direction is increased.

Also, as the crimping terminal 10 is manufactured in order of the above-described processes, the work hardening portion E is formed at the central portion in the width direction of the bottom plate of the conductor crimping portion by the crushing. Thus, since it is possible to simply obtain the desired crimping terminal 10, the manufacturing of the same is also simple.

In the meantime, the crimping terminal 10 of the above illustrative embodiment has the bottom plate 21 of the conductor crimping portion 12, which is bent into the substantially U-shaped section. However, as shown in FIGS. 6 and 7, the invention is also applied to a crimping terminal having the bottom plate 21 of a conductor crimping portion 212, which has a flat plate shape and has a substantially right-angled U-shaped section.

Figure 6:
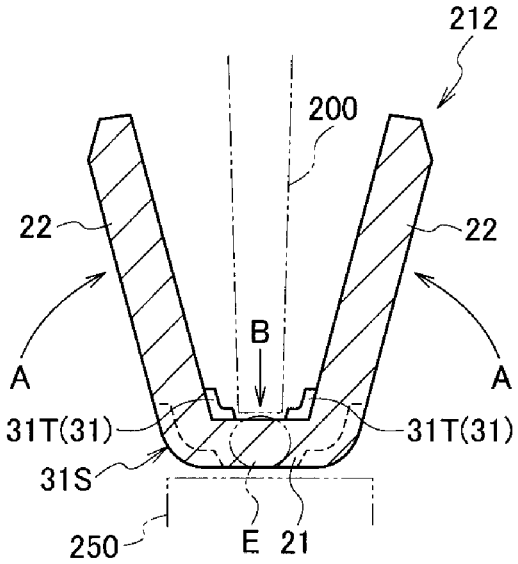
FIG. 6 is a sectional view showing an article state before a conductor crimping portion of a crimping terminal according to another illustrative embodiment of the invention is swaged to a conductor.
Figure 7:
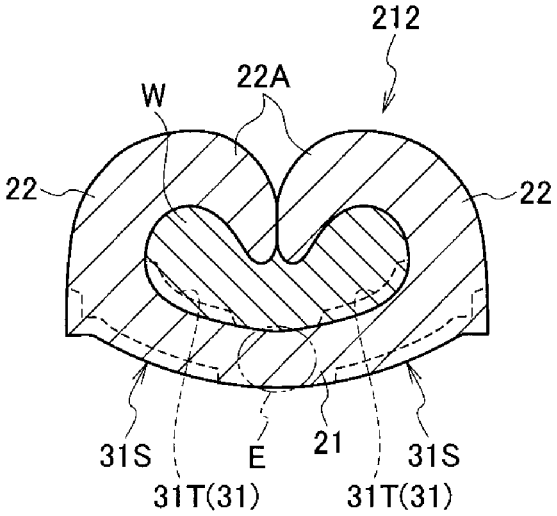
FIG. 7 is a sectional view showing an article state after the conductor crimping portion of the crimping terminal is swaged to the conductor.
Figure 8A:
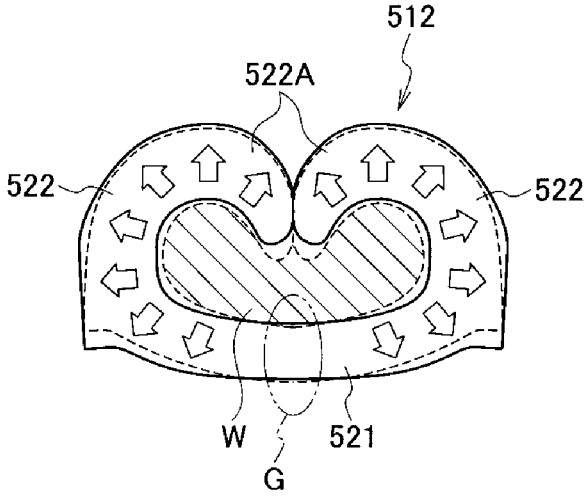
Figure 8B:
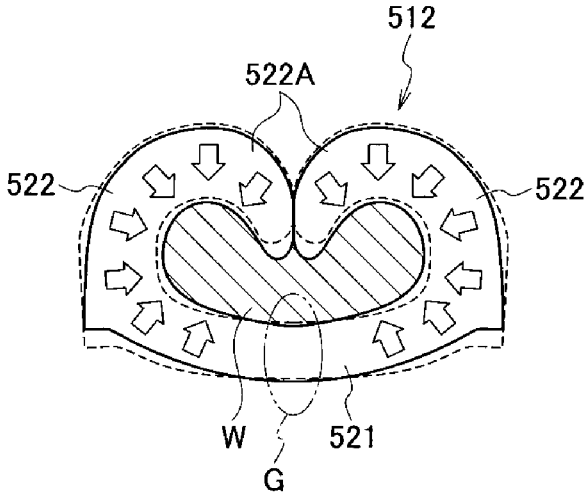

FIG. 6 is a sectional view showing an article state before the conductor crimping portion 212 of the crimping terminal is swaged to the conductor W and FIG. 7 is a sectional view showing a state after the conductor crimping portion of the crimping terminal is swaged to the conductor.

In this case, a shape of a leading end of a crushing mold 200 or a shape of a bearing surface of a bearing stand 250 is preferably formed to match the flat shape of the bottom plate 21 of the conductor crimping portion 212. By doing so, it is possible to obtain the same effects as the illustrative embodiment shown in FIGS. 1A to 5.

Also, in the above illustrative embodiment, the portions at which the beads 31 are first formed are set at the positions avoiding the central portion of the bottom plate 21 in the width direction for which the crushing is performed. However, it may be also possible that the convex portions of the beads 31 are formed in advance at portions for which the crushing will be performed and then the convex portions of the beads are crushed by the crushing to thus form the work hardening portion at a later stage. In this case, the beads made once are crushed, so that the higher hardening effect may be thus expected.

Although the invention has been specifically described with reference to the specific illustrative embodiments, it is obvious to one skilled in the art that a variety of changed and modifications can be made without departing from the spirit and scope of the invention.

This application is based on Japanese Patent Application No. 2010-092133 filed on Apr. 13, 2010, the disclosures of which are incorporated herein by reference.

INDUSTRIAL APPLICABILITY

According to the crimping terminal of the invention, since the work hardening portion is provided at the central portion in the width direction of the bottom plate of the conductor crimping portion by the crushing, it is possible to reduce the movement of the bottom plate, upon the thermal impact from the central portion in the width direction of the bottom plate. Also, since the beads having the work hardening effect are formed at the portions from the bottom plate to the conductor swage pieces, it is possible to lower the Young's modulus of the corresponding portions, thereby suppressing the deformation upon the thermal impact. Accordingly, it is possible to suppress the lowering of the crimping performance on the electric wire, which is caused due to the repeated deformation resulting from the thermal impact, so that it is possible to stably suppress the increase in contact resistance between the terminal and the electric wire for a long time.

DESCRIPTION OF REFERENCE NUMERALS

10: crimping terminal
12, 212: conductor crimping portion
21: bottom plate
22, 22: one pair of conductor swage pieces
31: bead
31T: convex portion
100, 200: crushing mold
105: recess portion for escaping the bead
E: work hardening portion

The invention claimed is:

1. A crimping terminal having a conductor crimping portion that is crimped and connected to a conductor of an electric wire, the crimping terminal formed into a substantially U-shaped section with a curved bottom plate or a substantially right-angled U-shaped section with a planar bottom plate by the bottom plate having an inner surface on which the conductor of the electric wire is placed and a pair of left and right conductor swage pieces each of which extends from both left-right sides of the bottom plate, is rolled inward to wrap the conductor placed on the inner surface of the bottom plate and is swaged so that a leading end thereof is crimped to the conductor, wherein a bead is formed at least on a wall plate at any position in a range from the bottom plate to the left and right conductor swage pieces, the bead being formed in a convex shape on an inner surface of the wall plate by punching an outer surface of the wall plate into a concave shape, and wherein a work hardening crushed portion is provided at a central portion of the bottom plate in a width direction thereof.

2. A method of manufacturing a crimping terminal having a conductor crimping portion that is crimped and connected to a conductor of an electric wire, the crimping terminal formed into a substantially U-shaped section with a curved bottom plate or a substantially right-angled U-shaped section with a planar bottom plate by the bottom plate having an inner surface on which the conductor of the electric wire is placed and a pair of left and right conductor swage pieces each of which extends from both left-right sides of the bottom plate, is rolled inward to wrap the conductor placed on the inner surface of the bottom plate and is swaged so that a leading end thereof is crimped to the conductor, the method comprising:

forming a flat developed terminal shape on one metal plate by press punching and concurrently forming at least one bead on at least one wall plate at any position in a range from the bottom plate to the conductor swage pieces, the at least one bead being formed in a convex shape on an inner surface of the at least one wall plate by punching an outer surface side of the wall plate into a concave shape at the time of bending the wall plate to form the conductor swage pieces from the bottom plate, and after the forming, crushing a central portion of the bottom plate in a width direction thereof by a crushing mold; and bending the conductor swage pieces from the bottom plate with the bead being left as it is and the crushed part of the bottom plate serving as a work hardening portion, wherein the crushing step occurs before crimping the terminal to the conductor.

* * * * *